US009156060B2

(12) United States Patent
Tomohisa et al.

(10) Patent No.: US 9,156,060 B2
(45) Date of Patent: Oct. 13, 2015

(54) METHOD FOR PRODUCING WATERPROOF ORGANIC THIN FILM

(71) Applicant: NITTO DENKO CORPORATION, Ibaraki-shi, Osaka (JP)

(72) Inventors: Hiroshi Tomohisa, Ibaraki (JP); Toru Umemoto, Ibaraki (JP); Shoichi Matsuda, Ibaraki (JP); Tadayuki Kameyama, Ibaraki (JP)

(73) Assignee: NITTO DENKO CORPORATION, Ibaraki-shi (JP)

( * ) Notice: Subject to any disclaimer, the term of this patent is extended or adjusted under 35 U.S.C. 154(b) by 0 days.

(21) Appl. No.: 13/763,038

(22) Filed: Feb. 8, 2013

(65) Prior Publication Data

US 2013/0209691 A1 Aug. 15, 2013

(30) Foreign Application Priority Data

Feb. 9, 2012 (JP) ..... 2012-025799
Nov. 30, 2012 (JP) ..... 2012-262729

(51) Int. Cl.
*B05D 5/00* (2006.01)
*B05D 3/12* (2006.01)
(Continued)

(52) U.S. Cl.
CPC .. *B05D 5/00* (2013.01); *B05D 1/18* (2013.01); *B05D 7/04* (2013.01)

(58) Field of Classification Search
CPC ..... B05D 1/18; B05D 5/00; B05D 7/04
USPC ..... 427/346
See application file for complete search history.

(56) References Cited

U.S. PATENT DOCUMENTS 5,906,862 A * 5/1999 Yapel et al. ..... 427/378
2001/0038910 A1* 11/2001 MacQueen et al. ..... 428/327
(Continued)

FOREIGN PATENT DOCUMENTS

CN 1892423 A 1/2007
CN 1938616 A 3/2007
(Continued)

OTHER PUBLICATIONS

Korean Office Action dated Feb. 25, 2014, issued in Korean Patent Application No. 10-2012-0151912, w/partial English translation.
(Continued)

*Primary Examiner* — Dah-Wei D Yuan
*Assistant Examiner* — Kristen A Dagenais
(74) *Attorney, Agent, or Firm* — Westerman, Hattori, Daniels & Adrian, LLP

(57) ABSTRACT

The present invention provides a method for producing a waterproof organic thin film being capable of restraining the generation of defects such as a crack. The method for producing a waterproof organic thin film includes a waterproofing step of preparing a long laminate having an organic thin film and bringing at least the organic thin film into contact with a waterproofing-treatment liquid, a washing step of washing at least the organic thin film surface of the long laminate, and a conveying step to be performed between the waterproofing step and the washing step, the conveying step being a step of conveying the long laminate from the waterproofing step to the washing step, wherein in the conveying step, the long laminate is conveyed while the waterproofing-treatment liquid remaining on the organic thin film surface is caused to flow relatively to the organic thin film surface.

5 Claims, 2 Drawing Sheets

(51) Int. Cl.

| | |
|---|---|
| ***B05D 7/04*** | (2006.01) |
| ***B05D 1/18*** | (2006.01) |

(56) References Cited

U.S. PATENT DOCUMENTS

| | | | | |
|---|---|---|---|---|
| 2008/0007829 | A1 * | 1/2008 | Mizushima et al. | 359/485 |
| 2009/0147359 | A1 | 6/2009 | Wada et al. | |
| 2010/0314784 | A1 * | 12/2010 | Miyazaki et al. | 264/1.35 |
| 2011/0070363 | A1 * | 3/2011 | Komatsubara et al. | 427/163.1 |
| 2011/0134526 | A1 | 6/2011 | Umemoto et al. | |
| 2011/0205629 | A1 | 8/2011 | Umemoto et al. | |
| 2011/0297897 | A1 | 12/2011 | Umemoto et al. | |
| 2012/0241077 | A1 | 9/2012 | Hada et al. | |

FOREIGN PATENT DOCUMENTS

| | | | | |
|---|---|---|---|---|
| CN | 101137917 | A | | 3/2008 |
| CN | 101932449 | A | | 12/2010 |
| CN | 102066995 | A | | 5/2011 |
| CN | 102089686 | A | | 6/2011 |
| CN | 102216818 | A | | 10/2011 |
| JP | 2007-226212 | A | | 9/2007 |
| JP | 2009-015273 | A | | 1/2009 |
| JP | 2009063829 | A | * | 3/2009 |
| JP | 2009-199075 | A | | 9/2009 |
| JP | 2009-292074 | A | | 12/2009 |
| JP | 2010-197760 | A | | 9/2010 |
| JP | 2010-266507 | A | | 11/2010 |
| JP | 4728447 | B1 | | 7/2011 |
| KR | 10-2006-0120714 | A | | 11/2006 |
| KR | 10-2009-0026067 | A | | 3/2009 |
| TW | 201000529 | A1 | | 1/2010 |
| WO | WO 2009147872 | A1 | * | 12/2009 |

OTHER PUBLICATIONS

Korean Office Action dated Oct. 27, 2014, issued in Korean Patent Application No. 10-2012-151912; w/English Translation. (7 pages).

Chinese Office Action dated Oct. 23, 2014, issued in Chinese Application No. 201300482349; w/ English Translation. (12 pages).

Office Action dated Mar. 27, 2015, issued in corresponding Taiwanese Patent Application No. 101147790, with English translation (11 pages).

Office Action dated Jun. 8, 2015, issued in counterpart Chinese Patent Application No. 201310048234.9, w/English partial translation (15 pages).

Office Action dated Jun. 1, 2015, issued in corresponding Korean Patent Application No. 10-2012-0151912 with English translation (7 pages).

Office Action dated Aug. 3, 2015, issued in Korean application No. 10-2012-0151912, with English translation (9 pages).

* cited by examiner

METHOD FOR PRODUCING WATERPROOF ORGANIC THIN FILM

TECHNICAL FIELD

The present invention relates to a method for producing a waterproof organic thin film.

BACKGROUND ART

Hitherto, in order to waterproof an organic thin film containing an organic colorant, the organic thin film is subjected to waterproofing treatment of bringing a waterproofing-treatment liquid into contact with the film (Patent Documents 1 to 4).

In the waterproofing treatment of the organic thin film, the organic thin film easily causes defects, for example, the film is cracked or peeled from the substrate.

Patent Document 2 discloses that a waterproofing treatment liquid containing a tetrahydroxyborate anion is used to waterproof an organic thin film, thereby making it possible to restrain the film from being cracked.

Patent Document 3 discloses that an organic thin film is continuously waterproofed without damaging the film mechanically, thereby making it possible to restrain a crack or other defects from being generated in the film.

The methods of Patent Document 2 and Patent Document 3 are each preferable since the generation of defects can be restrained when an organic thin film is waterproofed.

In the meantime, in the production of a long waterproof organic thin film, a waterproofed organic thin film is generally conveyed and washed.

In this conveying step, a crack or other defects may be generated in the organic thin film. Thus, it is necessary to overcome this inconvenience.

Patent Document 1: JP-A-2010-266507
Patent Document 2: JP-A-2010-197760
Patent Document 3: JP-A-2009-292074
Patent Document 4: JP-A-2009-199075

SUMMARY OF INVENTION

An object of the present invention is to provide a method for producing a waterproof organic thin film, this method being capable of restraining the generation of defects such as a crack.

The inventors have minutely examined, from various angles, causes for generating defects such as a crack to find out that the defects are easily generated in a process of conveying an organic thin film from a waterproofing step thereof to a washing step thereof. It is presumed that this is caused by a matter that a waterproofing-treatment liquid remaining on the organic thin film surface is locally concentrated when the film is conveyed.

On the basis of this presumption, the inventors have repeated trials and errors to achieve the present invention.

A method for producing a waterproof organic thin film of the present invention includes: a waterproofing step of preparing a long laminate having an organic thin film, and bringing at least the organic thin film into contact with a waterproofing-treatment liquid; a washing step of washing at least the organic thin film surface of the long laminate; and a conveying step to be performed between the waterproofing step and the washing step, the conveying step being a step of conveying the long laminate from the waterproofing step to the washing step, wherein in the conveying step, the long laminate is conveyed while the waterproofing-treatment liquid remaining on the organic thin film surface is caused to flow relatively to the organic thin film surface.

In a preferred method for producing a waterproof organic thin film of the present invention, the conveying step includes conveying the long laminate in the state of inclining the organic thin film surface to a horizontal plane.

Preferably, the inclination angle of the organic thin film surface to the horizontal plane is 1 to 45 degrees.

Preferably, the long laminate is conveyed in the state of inclining the organic thin film surface obliquely downward from the downstream side of a conveying direction of the long laminate to the upstream side of the conveying direction.

In a preferred method for producing a waterproof organic thin film of the present invention, the conveying step includes conveying the long laminate while wind is blown onto the organic thin film surface.

Preferably, the wind is blown from the downstream side of a conveying direction of the long laminate to the upstream side of the conveying direction.

In a preferred method for producing a waterproof organic thin film of the present invention, the waterproof organic thin film includes an organic colorant, and the waterproofing-treatment liquid includes a crosslinking agent for crosslinking the organic colorant.

In a preferred method for producing a waterproof organic thin film of the present invention, the waterproofing-treatment liquid remaining on the organic thin film surface is caused to flow into a conveying direction of the long laminate, or a direction reverse to the conveying direction.

According to the production method of the present invention, a waterproof organic thin film can be obtained wherein the generation of defects such as a crack is restrained. An optical laminate having the waterproof organic thin film of the present invention is integrated into, for example, an image display device, whereby the device can give an image unvaried in display performance over a long term.

DESCRIPTION OF EMBODIMENTS

[Outline of the Method for Producing Waterproof Organic Thin Film]

The production method of the present invention includes: a waterproofing step of preparing a long laminate having an organic thin film, and bringing at least the organic thin film into contact with a waterproofing-treatment liquid; a washing step of washing at least the organic thin film surface of the long laminate; and a conveying step to be performed between the waterproofing step and the washing step, the conveying step being a step of conveying the long laminate from the waterproofing step to the washing step. As far as the method of the present invention for producing a waterproof organic thin film essentially has the waterproofing step, the conveying step and the washing step, the method may have any other step. The method may have, for example, a film-forming step of forming the organic thin film before the waterproofing step.

The present invention is characterized in that in the conveying step, the long laminate is conveyed while the waterproofing-treatment liquid remaining on the organic thin film surface is caused to flow relatively to the organic thin film surface.

Incidentally, in the present specification, the wording "XXX to YYY" means that "XXX or more and YYY or less".

Figure 1:
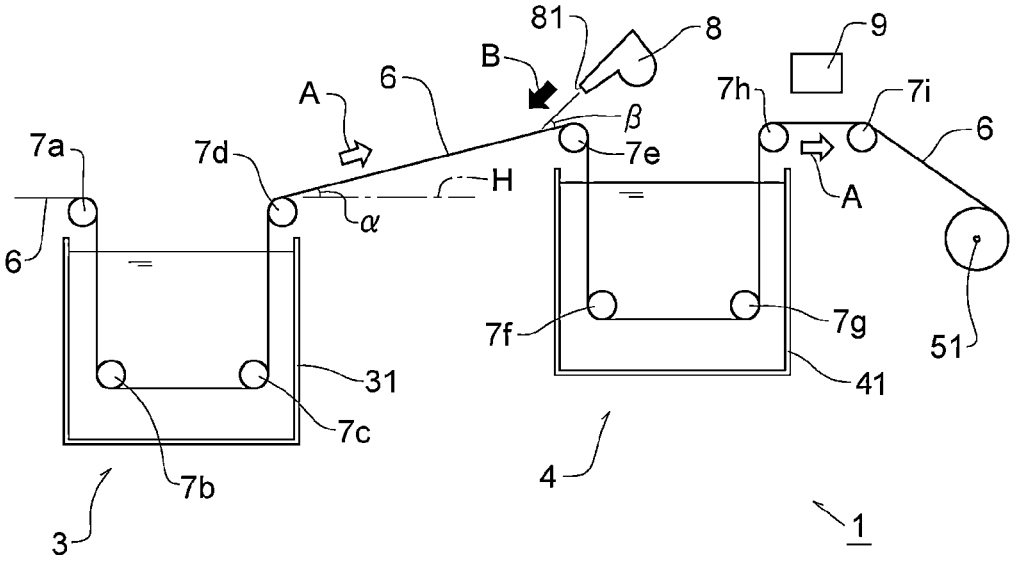
FIG. 1 is a schematic referential view illustrating an apparatus for producing a waterproof organic thin film.

FIG. 1 is a schematic referential view illustrating an apparatus for producing a waterproof organic thin film of the present invention.

The apparatus, which is an apparatus 1, for producing a waterproof organic thin film has at least a film-forming unit (not illustrated) for performing a film-forming step, a waterproofing-treatment unit 3 for performing a waterproofing step, and a washing unit 4 for performing a washing step.

Any shape specified by the word "long" means a shape about which its side along one direction (conveying direction) is sufficiently long relatively to a direction orthogonal to the direction. In the shape specified by word "long", for example, the length of the side in the conveying direction is 10 m or more, and preferably 300 m or more.

In the present invention, the use of a long substrate makes it possible to produce a waterproof organic thin film in a roll-to-roll manner. However, the present invention is not limited to any case where a waterproof organic thin film is produced in a roll-to-roll manner.

Hereinafter, referring appropriately to the drawings, each of the steps will be specifically described.

[Film-Forming Step]

The film-forming step is a step of forming an organic thin film on a long substrate to yield a long laminate.

For example, a long substrate wound around a roll is pulled out, and the long substrate is conveyed to a film-forming unit.

A rotating roller or some other is used to convey the long substrate from the upstream side of the conveying direction to the downstream side thereof.

An applicator is used to apply a coating liquid onto the long substrate conveyed into the film-forming unit.

By the application of the coating liquid, a coating film is formed on a surface of the long substrate.

If necessary, the coating film is dried through a drying machine. While the long substrate is conveyed after the application of the coating liquid, the coating film may be naturally dried to be solidified. In this case, the drying through the drying machine is omitted. The dried coating film is an organic thin film. Accordingly, at the downstream side of the conveying direction from the film-forming unit, a long laminate is conveyed which has the long substrate and the organic thin film laminated on the long substrate surface.

The long substrate is not particularly limited, however, a conventionally known substrate may be used. Examples of the long substrate include such as a polymer film.

The polymer film is not particularly limited, however, a film being excellent in transparency (for example, having a haze value of 5% or less) is preferable.

A thickness of the long substrate can be suitably designed in accordance with the strength and the like. However, in terms of thickness reduction and weight reduction, the thickness of the long substrate is preferably 300 μm or less, further preferably 5 to 200 μm, and more preferably 10 to 100 μm.

The long substrate surface (surface onto which the coating liquid is to be applied) may have orientation regulating force. The orientation regulating force may be created by subjecting the long substrate surface to orientation treatment. Examples of the orientation treatment include mechanical orientation treatments such as rubbing treatment, and chemical orientation treatments such as optical orientation treatment.

The coating liquid includes an organic thin film-forming material and a solvent wherein the material is dissolved or dispersed.

The organic thin film-forming material and the solvent are not particularly limited, however, the conventionally known one can be used.

Preferably, an organic colorant having an anionic group described below can be used as the forming material, and an aqueous solvent can be used as the solvent.

Examples of the aqueous solvent include water, a hydrophilic solvent, and a mixed solvent containing water and the hydrophilic solvent. The hydrophilic solvent is a solvent, which can be dissolved with water uniformly. Examples of the hydrophilic solvent include, for example, alcohols such as methanol, ethanol, methyl alcohol and isopropyl alcohol; glycols such as ethylene glycol, and diethylene glycol; cellosolves such as methyl cellosolve, and ethyl cellosolve; ketones such as acetone, and methyl ethyl ketone; esters such as acetic ether; and the like.

The organic colorant is, for example, preferably an azo compound represented by the following general formula (I) or (II).

(I)

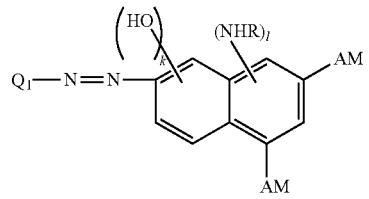

(II)

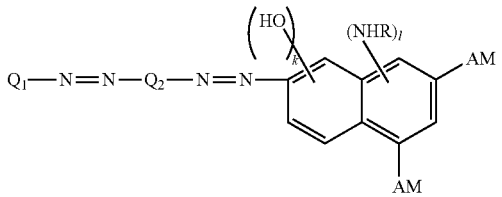

In the general formulae (I) and (II), $Q_1$ represents a substituted or unsubstituted aryl group, $Q_2$ represents a substituted or unsubstituted arylene group, A represents an anionic group, M represents a counterion of the anionic group, R represents a hydrogen atom, a substituted or unsubstituted alkyl group having 1 to 3 carbon atoms, a substituted or unsubstituted acetyl group, a substituted or unsubstituted benzoyl group, or a substituted or unsubstituted phenyl group, k represents an integer of 0 to 4, and 1 represents an integer of 0 to 4. Here, in the formulae (I) and (II), $k+1 \leq 5$. In the present specification, the wording "substituted or unsubstituted" means that "a certain group is substituted with a substituent, or is not substituted with any substituent".

The azo compound represented by the formula (I) or (II) has two or more anionic groups in the molecule thereof, and the 2 anionic groups (A in the formula) in the naphthyl group are bonded thereto at a meta-position.

The aryl group or arylene group represented by $Q_1$ or $Q_2$ may have a substituent or no substituent. Whether the aryl group or arylene group represented by $Q_1$ or $Q_2$ is substituted or unsubstituted, the azo compound represented by the general formula (I) or (II) exhibits absorption dichroism.

In the case where the aryl group or the arylene group has a substituent, the substituent is, for example, a halogeno group, a nitro group, a cyano group, a dihydroxy propyl group, a phenyl amino group, —OM, —COOM, —$SO_3M$, an alkyl group having 1 to 6 carbon atoms, an alkoxy group having 1 to 6 carbon atoms, an alkyl amino group having 1 to 6 carbon atoms, an acyl amino group having 1 to 6 carbon atoms, and the like. The substituent is preferably an anionic group such as a nitro group or a —$SO_3M$ group. Here, M represents a counter ion.

In the case where the alkyl group having 1 to 3 carbon atoms, a benzoyl group, or a phenyl group represented by R in each of the general formulae (I) and (II) has a substituent, examples of the substituent include the same substituents exemplified as substituents of the aryl group, as described above.

As examples of the aryl group, a condensed ring group where a benzene ring is condensed, such as a naphthyl group, can be cited, in addition to a phenyl group.

As examples of the arylene group, a condensed ring group where a benzene ring is condensed, such as a naphthylene group, can be cited, in addition to a phenylene group.

$Q_1$ in the general formulae (I) and (II) is preferably a substituted or unsubstituted phenyl group, and more preferably a phenyl group having a substituent at a para-position.

$Q_2$ in the general formula (II) is preferably a substituted or unsubstituted naphthylene group, and more preferably a substituted or unsubstituted 1,4-naphthylene group.

A in the general formulae (I) and (II) is, for example, a sulfonic acid group, a carboxyl group, a phosphate group, or a salt thereof. A is preferably a sulfonic acid group or a sulfonate group, and more preferably a sulfonate group.

M in the general formulae (I) and (II) is a hydrogen atom, an alkali metal atom, an alkaline earth metal atom, or a metal ion. After the organic thin film containing an azo compound represented by the general formula (I) or (II) is subjected to waterproofing treatment, all or part of M in the general formula (I) or (II) turns into a cationic specie originating from a waterproofing treatment liquid.

R in the general formulae (I) and (II) is preferably a hydrogen atom or a substituted or unsubstituted alkyl group having 1 to 3 carbon atoms, and more preferably a hydrogen atom.

Furthermore, k in the general formulae (I) and (II) is preferably an integer of 0 to 2, and more preferably an integer of 0 to 1. In the general formulae (I) and (II), 1 is preferably an integer of 0 to 2, and more preferably an integer of 0 to 1.

The organic colorant is preferably an azo compound represented by the following general formula (III).

(III)

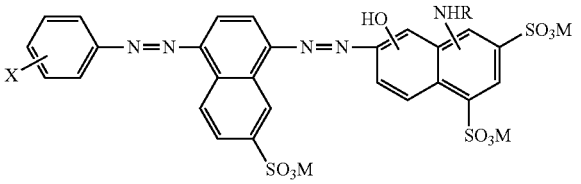

In the general formula (III), X represents a hydrogen atom, a halogen atom, a nitro group, a cyano group, a substituted or unsubstituted alkyl group having 1 to 4 carbon atoms, a substituted or unsubstituted alkoxy group having 1 to 4 carbon atoms, or a —$SO_3M$ group.

R and M in the general formula (III) are identical with R and M in the general formula (I), respectively.

In the case where the alkyl group having 1 to 4 carbon atoms or the alkoxy group having 1 to 4 carbon atoms represented by X in the general formula (III) has a substituent, examples of the substituent include the same substituents exemplified as substituents of the aryl group.

X in the general formula (III) is preferably a hydrogen atom, a nitro group, or a cyano group, and more preferably a nitro group.

The azo compounds represented by the general formulae (I) to (III) can each be obtained by, for example, the following method: an aniline derivative and a naphthalenesulfonic acid derivative are caused to undergo diazotization and coupling reaction in a usual manner to yield a monoazo compound; this monoazo compound is diazotized; and then the resultant is caused to undergo coupling reaction with an aminonaphtholdisulfonic acid derivative.

Besides the above-mentioned organic colorants and solvent, for example, organic colorants and solvents disclosed in Patent Documents 1 to 4 may be used. Description about the organic solvents and others in each of the documents that may be used in the invention is incorporated into the present specification to be regarded as a part of the specification. Thus, the description is omitted herein.

The organic colorant in the coating liquid forms supermolecules in the solvent. As a result, the coating liquid exhibits a liquid crystal phase. The liquid crystal phase is not particularly limited, and examples of the liquid crystal phase include a nematic liquid crystal phase, a middle phase, a smectic liquid crystal phase, a cholesteric liquid crystal phase, a hexagonal liquid crystal phase, or the like. The liquid crystal phase can be identified and confirmed from an optical pattern when observed by using a polarization microscope.

The organic colorant such as the azo compound forms supermolecules when the organic colorant is dissolved in the solvent (that is, the organic colorant forms supermolecules in the coating liquid). When a coating liquid containing the organic colorant flows and spreads in a predetermined direction, shear force is applied to the supermolecules. As a result, a coating film where the long axes of the supermolecules are oriented in the direction in which the liquid flows and spreads can be formed. The obtained organic thin film exhibits excellent absorptive dichroism since the organic colorant is oriented in the predetermined direction.

In particular, in the azo compound represented by the general formula (III), the two or more —$SO_3M$ groups are not adjacent to each other. Thus, in the azo compound, the steric hindrance of the —$SO_3M$ groups to each other is small. Accordingly, before and after the waterproofing treatment, the azo compounds are linearly oriented so that a polarizer high in polarization degree can be obtained.

The concentration of the organic colorant in the coating liquid is preferably prepared so as to exhibit a liquid crystal phase. Specifically, the concentration of the organic colorant is preferably 0.5 to 50% by mass. In the partial range of this concentration, the coating liquid may exhibit a liquid crystal phase.

In addition, the pH of the coating liquid is preferably prepared about pH 4 to 10, and more preferably about pH 6 to 8.

Further, an additive may be added to the coating liquid. Examples of the additive include, for example, a plasticizer, a heat stabilizer, a light stabilizer, a lubricant, an antioxidant, an ultraviolet absorber, a flame retardant, a coloring agent, an antistatic agent, an antifungus agent, a compatibilizing agent, a cross-linking agent, a thickening agent, various polymers, and the like. The concentration of the additive in the coating liquid is preferably more than 0 and 10% by mass or less. A surfactant may be added to the coating liquid.

As described above, when the coating liquid flows and spreads in a predetermined direction, a shear force is applied to the supermolecules. As a result, a coating film where the supermolecules are oriented can be formed. A long laminate having a long substrate and an organic thin film laminated thereon can be obtained by drying the coating film.

The thickness of the organic thin film is not particularly limited, however, it is preferably 0.1 to 10 μm.

When an organic colorant having absorption capacity in a visible light region exemplified above is used, the organic thin film containing the organic colorant can be utilized as a polarizer. When an organic colorant which does not substantially have absorption capacity or has small absorption capacity in a visible light region is used, the organic thin film containing the organic colorant can be utilized as a retardation film.

When the organic thin film of the present invention is a polarizer, for example, it exhibits dichroism at a wavelength of at least a part of a visible light region (wavelength: 380 nm to 780 nm).

The transmittance of this organic thin film is 35% or more, preferably 36% or more, and further preferably 37% or more.

[Waterproofing Step]

The waterproofing step is a step of waterproofing the organic thin film yielded in the film-forming step. In the waterproofing step, a waterproofing-treatment liquid is brought into contact with at least the organic thin film surface of the long laminate.

The long laminate yielded in the film-forming step may be subsequently subjected to the waterproofing step, or may be once wound around a roll, and then pulled out from the roll to be subjected to the waterproofing step.

The method for bringing the organic thin film into contact with the waterproofing-treatment liquid is not particularly limited. Examples of this method include a method (A) of applying the waterproofing-treatment liquid onto the organic thin film surface, a method (B) of immersing the long laminate in a bath filled with the waterproofing-treatment liquid, and a method (C) of passing the long laminate through a bath filled with the waterproofing-treatment liquid. The application of the waterproofing-treatment liquid in the method (A) may be attained, using, for example, an appropriate coater or sprayer.

Of these methods, preferred is either of the method (B) of immersing the long laminate in the waterproofing-treatment liquid, or the method (C) of passing the long laminate through the waterproofing-treatment liquid. According to this method, the waterproofing-treatment liquid can be certainly brought into contact with the whole of the organic thin film. Additionally, according to the method, the waterproofing-treatment liquid is easily penetrated into the organic thin film.

It is preferred to penetrate the waterproofing-treatment liquid sufficiently into the organic thin film to wet the organic thin film surface of the long laminate sufficiently just after the waterproofing treatment. In particular, the method (B) or (C) makes it possible to penetrate the waterproofing-treatment liquid sufficiently into the organic thin film, and further yield, as the organic thin film, a film wetted with a sufficient amount of the liquid just after the long laminate is pulled out from the treatment bath.

Referring to FIG. 1, the following will describe a case where the waterproofing treatment is conducted according to the method (C):

A long laminate 6 having an organic thin film, which is yielded in a film-forming step as described above, is conveyed into a treatment bath 31 filled with a waterproofing-treatment liquid. The long laminate 6 is passed through the treatment bath 31 to bring the waterproofing-treatment liquid into contact with the organic thin film surface and the rear surface of the long substrate.

The long laminate is conveyed from the upstream side of the conveying direction to the downstream side thereof by means of rotating rollers 7*a*, 7*b*, 7*c*, 7*d*, 7*e*, 7*f*, 7*g*, 7*h*, and 7*i*.

The waterproofing-treatment liquid is not particularly limited, and the conventionally known one may be used. The waterproofing-treatment liquid contains, for example, a crosslinking agent having a function of crosslinking the organic colorant, and a solvent wherein the crosslinking agent is dissolved or dispersed.

Examples of the crosslinking agent and the solvent include crosslinking agents and solvents disclosed in Patent Document 1. The crosslinking agents disclosed in Patent Document 1 are each an organic nitrogen compound, and the solvents disclosed therein are each an aqueous solvent. As described in Patent Document 1, the organic nitrogen compound is, for example, an non-cyclic organic nitrogen compound having in the molecule thereof two or more cationic groups (preferably, cationic groups each containing a nitrogen atom). Examples of the non-cyclic organic nitrogen compound (non-cyclic aliphatic nitrogen compound) include aliphatic diamines such as alkylenediamine, or salts thereof; aliphatic triamines such as alkylenetriamines, or salts thereof; aliphatic tetramines such as alkylenetetramine, or salts thereof; aliphatic pentamines such as alkylenepentamine, or salts thereof aliphatic ether diamines such as alkylene ether diamine, or salts thereof; and the like. Usable examples of the aqueous solvent include the same aqueous solvents described in the column of the coating liquid.

Besides the crosslinking agents (organic nitrogen compounds) and the solvents disclosed in Patent Document 1, in the invention, for example, crosslinking agents and others disclosed in Patent Documents 2 to 4 may be used. Description about the crosslinking agents and the others in each of the documents that may be used in the invention is incorporated into the present specification to be regarded as a part of the specification. Thus, the description is omitted herein.

The concentration of the crosslinking agents in the waterproofing-treatment liquid is preferably 1 to 50% by mass, and further preferably 5 to 30% by mass.

When the organic thin film is brought into contact with the waterproofing-treatment liquid, the organic colorants in the organic thin film are crosslinked with each other through the crosslinking agent. The crosslinking gives a waterproof organic thin film excellent in waterproofness and mechanical strength.

[Conveying Step]

The conveying step is a step of conveying the long laminate after the waterproofing treatment to the washing step.

The conveying step is set between the waterproofing step and the washing step.

When the long laminate is conveyed in the conveying step from the waterproofing step to the washing step, the waterproofing-treatment liquid remaining on the organic thin film surface is caused to flow relatively to this surface. Preferably, the waterproofing-treatment liquid remaining on the organic thin film surface is caused to flow in the conveying direction of the long laminate, or in a direction reverse to the conveying direction.

The waterproofing-treatment liquid may be caused to flow in all zones through which the long laminate is conveyed from the waterproofing step to the washing step, or in a part of the zones. In other words, zones in which the waterproofing-treatment liquid is not caused to flow may be included in all the zones, through which the long laminate is conveyed from the waterproofing step to the washing step.

The conveying speed of the long laminate is not particularly limited, and may be appropriately set. Considering the efficiency of the production, the conveying speed of the long laminate is preferably 3 m/minute or more, and more preferably 5 m/minute or more. This speed is preferably 30 m/minute or less, and more preferably 25 m/minute or less. If this speed is too large, the waterproofing-treatment liquid remaining on the organic thin film surface may not flow satisfactorily.

The method for conveying the long laminate while the waterproofing-treatment liquid is caused to flow is not particularly limited. For example, the long laminate may be conveyed while the waterproofing-treatment liquid is spontaneously caused to flow, or while the liquid is forcibly caused to flow.

The method for conveying the long laminate while the waterproofing-treatment liquid is spontaneously caused to flow is, for example, a method of conveying the long laminate (organic thin film) while inclined.

The method for conveying the long laminate while the waterproofing-treatment liquid is forcibly caused to flow is, for example, a method of conveying the long laminate while wind is blown onto the organic thin film surface.

These methods may be used alone or in combination of two.

Preferred are (is) the method of conveying the long laminate while inclined, and/or the method of conveying the long laminate while wind is blown onto the organic thin film surface since the methods make it possible to cause the waterproofing-treatment liquid to flow relatively easily.

Figure 2:
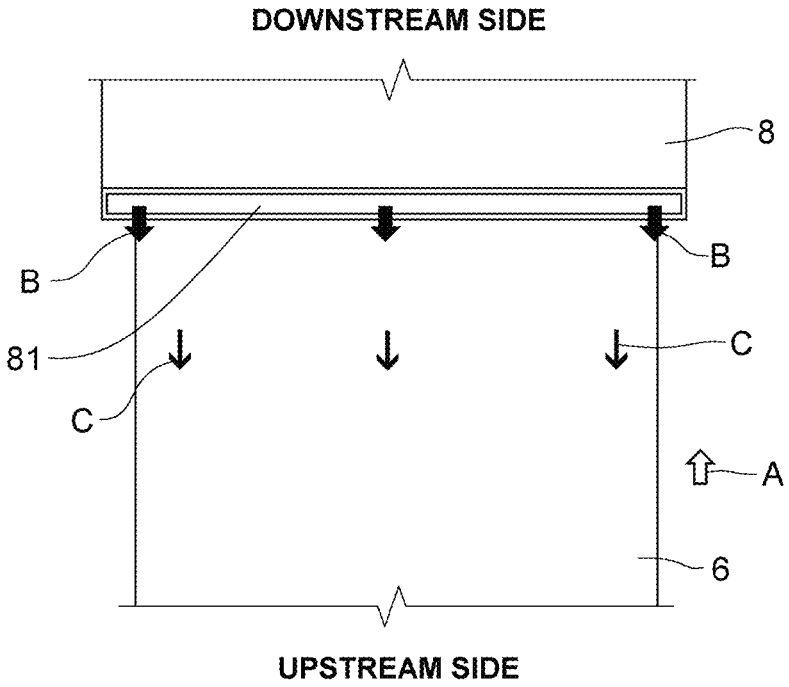
FIG. 2 is a partial perspective referential view illustrating a conveying step according to the production apparatus when the situation of the step is viewed from the downstream side of a conveying direction to the upstream side.

Referring again to FIG. 1, and to FIG. 2, the long laminate 6 pulled out from the waterproofing-treatment bath 31 is conveyed to a washing bath 41.

Specifically, the long laminate 6 having the organic thin film is pulled upward from the waterproofing-treatment bath 31, and then directed to the downstream side of the conveying direction through the roller 7*d*, which is a first rotating roller, and further directed downward through the roller 7*e*, which is a second rotating roller, to be introduced into the washing bath 41. The waterproofing-treatment liquid is adhering onto the organic thin film surface of the long laminate 6 pulled out from the waterproofing-treatment bath 31.

In the middle of the convey of the long laminate 6 from the waterproofing-treatment bath 31 to the washing bath 41 (between the first rotating roller 7*d* and the second rotating roller 7*e* in the illustrated embodiment), the long laminate 6 is conveyed to incline the organic thin film thereof to a horizontal plane H.

By conveying the long laminate 6 to be inclined to the horizontal plane H, the waterproofing-treatment liquid remaining on the organic thin film surface obeys the inclined plane to flow relatively to the organic thin film surface.

The inclination angle $\alpha$ of the organic thin film surface to the horizontal plane H is not particularly limited, and may be appropriately set. The angle $\alpha$ to the horizontal plane H is, for example, 1 to 45 degrees, preferably 1 to 20 degrees, and more preferably 1 to 10 degrees for the purpose of a satisfactory flow of the waterproofing-treatment liquid remaining on the organic thin film surface.

In the conveying step, the long laminate 6 may be obliquely downward inclined from the downstream side of the conveying direction to the upstream side thereof, or may be obliquely upward inclined from the downstream side of the conveying direction to the upstream side.

When the long laminate 6 is obliquely downward inclined from the downstream side of the conveying direction to the upstream side, the waterproofing-treatment liquid remaining on the organic thin film surface flows into a direction reverse to the conveying direction (represented by A) of the long laminate 6. The conveying direction A and the direction reverse thereto are directions reverse to each other by 180 degrees.

When the long laminate 6 is obliquely upward inclined from the downstream side of the conveying direction to the upstream side, the waterproofing-treatment liquid remaining on the organic thin film surface flows into the conveying direction A of the long laminate 6.

Preferably, as illustrated in FIG. 1, the long laminate 6 is conveyed while inclined obliquely downward from the downstream side of the conveying direction to the upstream side thereof. By conveying the laminate 6 obliquely upward to the downstream side, the waterproofing-treatment liquid remaining on the organic thin film surface is caused to flow toward the treatment bath 31 so that the waterproofing-treatment liquid can be restrained from being incorporated into the washing bath 41.

Furthermore, in the middle of conveying the long laminate 6 from the treatment bath 31 to the washing bath 41, wind may be blown onto the organic thin film surface. The wind blowing means a forcible flow of gas. The flow of gas that is followed by the conveying of the long laminate 6 and that acts onto the organic thin film surface is not the wind blowing.

The wind blowing is attained by use of, for example, a blowing device 8. The blowing device 8 is not particularly limited, and may be, for example, an air blower.

A main component of the wind may be the atmospheric air, or a specific gas such as oxygen, nitrogen or helium.

The direction of the wind is not particularly limited, and may be appropriately set. For example, the upstream side of the conveying direction may be rendered windward to blow the wind, toward the downstream side of the conveying direction, onto the organic thin film surface, or the downstream side of the conveying direction may be rendered windward to blow the wind, toward the upstream side of the conveying direction, onto the organic thin film surface.

Preferably, as illustrated in FIG. 1, the wind is blown from the downstream side of the conveying direction of the long laminate 6 to the upstream side thereof. By blowing of the wind toward the upstream side, the waterproofing-treatment liquid remaining on the organic thin film surface is caused to flow toward the treatment bath side. Thus, the waterproofing-treatment liquid can be restrained from being incorporated into the washing bath. In this case, the waterproofing-treatment liquid remaining on the organic thin film surface flows mainly to a direction reverse to a conveying direction A of the long laminate 6.

In FIGS. 1 and 2, outlined arrows A each represent the conveying direction of the long laminate, as described above. Blacked-out arrows B each represent the direction of the wind, and narrow arrows C each represent the flowing direction of the waterproofing-treatment liquid on the organic thin film surface.

The position where the wind is blown is not particularly limited, and may be appropriately set. Preferably, as illustrated in FIG. 1, from a position near the washing bath 41, the wind is blown onto the organic thin film surface. More preferably, from a position just before a position where the laminate is introduced into the washing bath 41, the wind is blown onto the organic thin film surface.

As illustrated in FIG. 2, when the wind is blown, it is preferred to blow the wind onto the long laminate 6 over the whole of the width thereof. It is more preferred to blow the wind into a substantially even gas flow rate onto the long laminate 6 over the whole of the width thereof. If the wind is blown locally onto the organic thin film surface, or blown in different gas flow rates onto individual portions of the surface, it is feared that the flow of the waterproofing-treatment liquid becomes uneven.

In FIG. 2, reference number 81 represents a wind outlet in the blowing device 8.

The gas flow rate of the wind is not particularly limited, and may be appropriately set. The gas flow rate is preferably 2 to 30 L/minute, and more preferably 5 to 20 L/minute per 100 $cm^2$ of the organic thin film surface.

The speed of the wind (wind velocity) is, for example, 5 to 30 m/second, and preferably 8 to 20 m/second. By blowing the wind having such wind velocity, the waterproofing-treatment liquid remaining on the organic thin film surface can be caused to flow satisfactorily.

The wind velocity means the speed of the wind on the organic thin film surface.

When the wind is blown, the wind may be blown in parallel to the organic thin film surface. Preferably, the wind is blown obliquely to the organic thin film surface.

For example, as illustrated in FIG. 1, the wind is blown in such a manner that when the long laminate is viewed from a side surface thereof, the angle β made between the direction of the wind (flow direction of the gas) and the organic thin film surface will be more than 0 degree and less than 90 degrees (acute angle). The wind is blown in such a manner that the angle β will be preferably 1 to 30 degrees, and more preferably 3 to 25 degrees. By blowing the wind to give such an angle, the waterproofing-treatment liquid can be caused to flow satisfactorily.

The temperature of the wind is not particularly limited, and may be, for example, 10 to 30° C. If the temperature of the blown wind is too high, the waterproofing-treatment liquid is dried on the organic thin film surface so that the crosslinking agent contained therein may be unfavorably crystallized. If the crosslinking agent is crystallized to be precipitated on the organic thin film surface, the crosslinking agent adhering onto the organic thin film surface may not be unfavorably cleaned up or removed even when the long laminate is washed in the washing step.

In the production apparatus 1 in FIGS. 1 and 2, in order to cause the waterproofing-treatment liquid remaining on the organic thin film surface to flow, the long laminate is conveyed while the long laminate is inclined and further the wind is blown onto the organic thin film surface. However, the long laminate may be conveyed while only either one of the following is performed: the laminate is inclined; and the wind is blown onto the organic thin film surface.

By causing the waterproofing-treatment liquid remaining on the organic thin film surface to flow, the waterproofing-treatment liquid can be prevented from being locally concentrated in places of the organic thin film surface.

When the remaining waterproofing-treatment liquid is locally concentrated, the organic thin film surface has areas where the waterproofing-treatment liquid is hardly present. If the areas are generated while the long laminate is conveyed, the crosslinking agents and others contained in the waterproofing-treatment liquid are easily solidified and crystallized. It is presumed that when the crosslinking agents and the others are crystallized, defects such as a crack are generated on the organic thin film.

As described above, according to the production method of the present invention, the waterproofing-treatment liquid can be prevented from being locally concentrated on the organic thin film surface; thus, the generation of defects can be restrained in the organic thin film.

[Washing Step]

The washing step is a step of using a washing liquid to wash at least the organic thin film surface of the waterproofed long laminate.

The execution of the washing step makes it possible to remove the waterproofing-treatment liquid remaining on the surface and rear surface of the long laminate (the organic thin film surface and the long substrate rear surface). Accordingly, the precipitation of the crosslinking agents and the others can be prevented on the front and rear surfaces of the long laminate.

The method for washing at least the organic thin film surface is not particularly limited.

Examples thereof include a method (i) of blowing a washing liquid onto the organic thin film surface, a method (ii) of immersing the long laminate in a bath wherein a washing liquid flows in a predetermined direction, and a method (iii) of passing the long laminate through a washing bath filled with a washing liquid.

Referring again to FIG. 1, the following will describe a case where the long laminate is washed in accordance with the method (iii):

In the conveying step, the long laminate 6 is conveyed into the washing bath 41 filled with a washing liquid. The long laminate 6 is passed through the washing bath 41, thereby to remove the waterproofing-treatment liquid, the crosslinking agents, and other substances that adhere to the organic thin film surface and the long substrate rear surface.

A drying unit 9 is located at the downstream side of the washing unit 4. The drying unit 9 makes it possible to dry the front and rear surfaces of the washed long laminate 6. When the long laminate 6 is naturally dried, the drying unit 9 is omitted.

This process gives, as the long laminate 6, a long laminate having a waterproof organic thin film. The resultant long laminate 6 is wound onto a roll 51.

The washing liquid is not particularly limited. Examples thereof include water, a mixed liquid composed of water and a hydrophilic organic compound, and a liquid hydrophilic organic compound.

The hydrophilic organic compound is preferably a liquid organic compound having, in the molecule thereof, a polar group.

The temperature of the washing liquid is not particularly limited, and is usually 20° C. to 50° C. The period when the long laminate is exposed to the washing liquid is not particularly limited, and is usually about 1 to 20 minutes.

When the front and rear surfaces of the long laminate are dried after the washing, the method for the drying may be natural drying or forcible drying. The drying temperature is not particularly limited, and is usually 20° C. to 60° C. The drying period may be a period required until the front and rear surfaces of the long laminate are dried.

[Usage of Waterproof Organic Thin Film]

The long laminate having the waterproof organic thin film of the present invention is used after cut into appropriate sizes.

If necessary, a protective film may be laminated on the surface of the long laminate, or each of the front and rear surfaces thereof.

The waterproof organic thin film yielded in the production method of the present invention may be used in the state of being laminated on the substrate, or peeled from the substrate.

The waterproof organic thin film of the present invention is preferably mounted on an image display device.

Examples of the image display device having the waterproof organic thin film of the present invention include a liquid crystal display device, an organic EL display, a plasma display, and the like. The preferable use of the image display device is a TV set.

EXAMPLES

The present invention will be described in detail by way of Examples and Comparative Examples. The present invention is not limited only to the following Examples. Each of measuring methods used in the Examples and the Comparative Examples are as follows.

[Measurement of Thickness of Organic Thin Film]

A portion of the organic thin film was peeled off from a polymer film and a step between the polymer film and the organic thin film was measured by using a three-dimensional non-contact surface form measuring system (product name: "Micromap MM5200," manufactured by Ryoka Systems Inc.).

[Method of Evaluating Defects of Any Organic Thin Film]

A long laminate having a waterproof organic thin film was put onto a backlight. While light was radiated onto the rear surface of the laminate, the organic thin film was observed under crossed nicol.

From the surface of the observed organic thin film, any ten regions independent of each other were optionally selected. Each of the regions was a region of 420 mm×1000 mm. The number of cracks included in the region was counted.

After the counting, the total number of the cracks was divided by 10. In this way, the average number of cracks per region was calculated out.

[Synthesis of Organic Colorant]

4-nitroaniline and 8-amino-2-naphthalenesulfonic acid were caused to undergo diazotization and coupling reaction by a usual method (a method described on pages 135 to 152 of "Riron Seizoh, Senryo Kagaku (Theory Production, Dye Chemistry), 5$^{th}$ Version" written by Yutaka Hosoda, and published by Gihodo Shuppan Co., Ltd. on Jul. 15, 1968) to yield a monoazo compound. The resultant monoazo compound was diazotized by the usual method, and further the resultant was caused to undergo a coupling reaction with 1-amino-8-naphthol-2,4-disulfonic acid lithium salt, thereby yielding a crude product. This was salted out with lithium chloride to yield an disazo compound having the following structural formula (1):

(1)

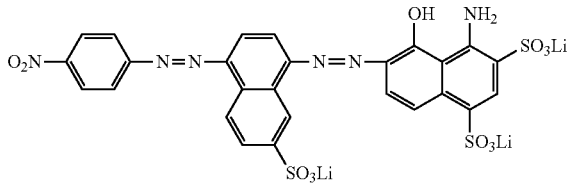

Example 1

The disazo compound of the formula (1) was dissolved into ion exchange water to prepare a 8% by mass of coating liquid.

As a long substrate, a norbornene based polymer film (product name: "ZEONOA" manufactured by Zeon Corporation) subjected to rubbing treatment and corona treatment was prepared. As the polymer film, a long polymer film having a thickness of 40 μm, a width of 440 mm and a length of 500 m was used.

While this long polymer film was conveyed in the longitudinal direction thereof, a coater having a known tension web die was used to apply the coating liquid onto the surface of the film. In this way, a coating film was formed on a band area having a width of 420 mm in the surface of the film.

After coating, the coating film was naturally dried. A long laminate where an organic thin film was laminated on the polymer film was obtained by drying. The thickness of the organic thin film was 0.4 μm.

Subsequently, the long laminate was conveyed and passed through a treatment bath filled with a waterproofing-treatment liquid. The period for the passage was adjusted to about 2 seconds. The used waterproofing-treatment liquid was an aqueous solution obtained by dissolving, into 90 parts by mass of ion exchange water, 10 parts by mass of a mixture of a hydrochloride salt of 1,3-propanediamine (manufactured by Tokyo Chemical Industry Co., Ltd.), a hydrochloride salt of 1,2-ethylenediamine (manufactured by Tokyo Chemical Industry Co., Ltd.), and bishexamethylenetriamine (manufactured by Tokyo Chemical Industry Co., Ltd.) (ratio by mass: 61:9:30).

The long laminate pulled out from the treatment bath was conveyed to be introduced to a washing bath filled with water.

Between the treatment bath and the washing bath, a zone (zone length: 1500 mm) was located for conveying the long laminate obliquely downward at an inclination angle (α in FIG. 1) of 3 degrees from the downstream side of the conveying direction to the upstream side thereof. Between the treatment bath and the washing bath, the conveying speed of the long laminate was set to 8 m/minute.

Simultaneously with the inclination conveying, an air blower arranged ahead, by 500 mm, of the washing bath was used to blow wind onto the organic thin film surface over the whole of the width thereof.

The gas flow rate of the wind was 10 L/minute per 100 cm$^2$ of the organic thin film surface, and the wind velocity was 15 m/second. The wind was blown from the downstream side of the conveying direction to the upstream side thereof at an angle (β in FIG. 1) of about 87 degrees to the organic thin film surface.

Between the treatment bath and the washing bath, the organic thin film surface, which was being conveyed, was observed with the naked eye. As a result, it was detected that the waterproofing-treatment liquid remaining on the surface was constantly flowing into a direction reverse to the conveying direction.

The long laminate was passed through the washing bath, and then naturally dried to yield a long laminate having a waterproof organic thin film.

About the resultant long laminate, the average number of cracks per unit area of the organic thin film was calculated out in accordance with a method of evaluating a defect of the above-mentioned organic thin film. The result is shown in Table 1.

Example 2

A long laminate wherein a waterproof organic thin film was laminated on the surface of a long substrate was produced in the same way as in Example 1 except that the inclination angle of the zone for the inclination conveying was changed to 15 degrees, and the wind was blown at an angle of about 75 degrees to the organic thin film surfaces. About the resultant long laminate, the average number of cracks per unit area of the organic thin film is shown in Table 1.

In Example 2 also, an observation with the naked eye was made about the organic thin film surface which was being conveyed from the treatment bath to the washing bath. As a result, it was detected that the waterproofing-treatment liquid remaining on the surface was constantly flowing into a direction reverse to the conveying direction.

Example 3

A long laminate wherein a waterproof organic thin film was laminated on the surface of a long substrate was produced in the same way as in Example 1 except that no wind was blown. About the resultant long laminate, the average number of cracks per unit area of the organic thin film is shown in Table 1.

In Example 3 also, an observation with the naked eye was made about the organic thin film surface which was being conveyed from the treatment bath to the washing bath. As a result, it was detected that the waterproofing-treatment liquid remaining on the surface was constantly flowing into a direction reverse to the conveying direction.

Comparative Example

A long laminate wherein an organic thin film was laminated on the surface of a long substrate was produced in the same way as in Example 1 except that the organic thin film was conveyed to keep the surface thereof in parallel to a horizontal plane (without setting any inclination conveying zone), and no wind was blown. About the resultant long laminate, the average number of cracks per unit area of the organic thin film is shown in Table 1.

In Comparative Example also, an observation with the naked eye was made about the organic thin film surface which was being horizontally conveyed from the treatment bath to the washing bath. The waterproofing-treatment liquid remaining on the surface was hardly flowing, and individually-independent regions where the liquid was locally concentrated were found out.

| | Inclination angle during conveying | Wind blowing | Average number of cracks |
|---|---|---|---|
| Example 1 | Three degrees to horizontal plane | Done | 5 |
| Example 2 | Fifteen degrees to horizontal plane | Done | 4 |
| Example 3 | Three degrees to horizontal plane | Not done | 21 |
| Comparative Example | Parallel to horizontal plane | Not done | 52 |

Reference Example

In Reference Example, an organic thin film was formed, using a short substrate without using any long substrate.

Specifically, the used substrate was a norbornene-based polymer film (product name: "ZEONOA" manufactured by Zeon Corporation) having a thickness of 40 μm, a width of 50 mm and a length of 50 mm and subjected to rubbing treatment and corona treatment.

A bar coater (product name "Mayer rot HS4", manufactured by Bushman Co.) was used to apply the same coating liquid as used in Example 1 onto the surface of the polymer film, and the resultant was sufficiently dried naturally in a thermostat having a temperature of 23° C. By the drying, a laminate wherein an organic thin film was formed on the polymer film was produced. The thickness of the organic thin film was 0.4 μm.

This laminate was immersed in the same treatment bath as used in Example 1, which was filled with the waterproofing-treatment liquid, and then taken out from the treatment bath. The laminate was then horizontally kept for 16 seconds. Thereafter, the front and rear surfaces of the laminate were sufficiently washed with water, and then naturally dried.

Figure 3:
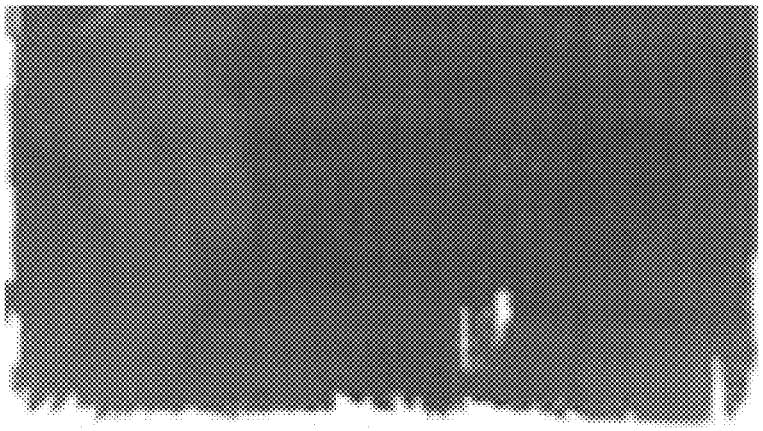
FIG. 3 is a photographic image view of the organic thin film surface produced in the Reference Example.

The organic thin film surface of the dried laminate was observed with the naked eye under crossed nicol. As a result, many cracks were generated mainly at edge portions of the organic thin film. FIG. 3 is a photographic image view of the organic thin film surface.

INDUSTRIAL APPLICABILITY

The method of the invention for producing a waterproof organic thin film can be favorably used to produce an organic thin film excellent in waterproofness.

A waterproof organic thin film produced by the production method of the invention may be used as, for example, a liquid crystal display device, any other image display device, or polarized sunglasses.

1 Apparatus for Producing Waterproof Organic Thin Film
3 Waterproofing-Treatment Unit
31 Treatment Bath
4 Washing Unit
41 Washing Bath
A Conveying Direction of Long Laminate
B Direction of Wind
C Flowing Direction of the Waterproofing-Treatment Liquid

What is claimed is:

1. A method for producing a waterproof organic thin film, comprising: a waterproofing step of preparing a long laminate having an organic thin film, and bringing at least the organic thin film into contact with a waterproofing-treatment liquid;

a washing step of washing at least the organic thin film surface of the long laminate; and a conveying step to be performed between the waterproofing step and the washing step, the conveying step being a step of conveying the long laminate from the waterproofing step to the washing step;

wherein in the conveying step, the long laminate is conveyed while the waterproofing-treatment liquid remaining on the organic thin film surface is caused to flow relatively to the organic thin film surface, the long laminate is continuous in a conveying direction, and the conveying step comprises conveying the long laminate in the state of inclining the organic thin film surface to a horizontal plane while wind is blown onto the organic thin film surface, wherein the inclination angle of the organic thin film surface to the horizontal plane is 1 to 45 degrees, and the speed of the wind is 5 to 30 m/second.

2. The method for producing a waterproof organic thin film according to claim 1, wherein the wind is blown from the downstream side of a conveying direction of the long laminate to the upstream side of the conveying direction.

3. The method for producing a waterproof organic thin film according to claim 1, wherein the long laminate is conveyed in the state of inclining the organic thin film surface obliquely downward from the downstream side of a conveying direction of the long laminate to the upstream side of the conveying direction.

4. The method for producing a waterproof organic thin film according to claim 1, wherein the organic thin film comprises an organic colorant, and the waterproofing-treatment liquid comprises a crosslinking agent for crosslinking the organic colorant.

5. The method for producing a waterproof organic thin film according to claim 1, wherein the waterproofing-treatment liquid remaining on the organic thin film surface is caused to flow into a conveying direction of the long laminate, or a direction reverse to the conveying direction.

* * * * *